United States Patent [19]

Vick

[11] Patent Number: 4,794,845

[45] Date of Patent: Jan. 3, 1989

[54] DIRECT DRIVE ROTARY SERVO VALVE

[75] Inventor: Ralph L. Vick, Granada Hills, Calif.

[73] Assignee: Allied-Signal Inc., Morristown, N.J.

[21] Appl. No.: 90,886

[22] Filed: Aug. 31, 1987

[51] Int. Cl.[4] ..... F15B 13/044

[52] U.S. Cl. ..... 91/387; 91/459; 91/467; 137/625.23; 137/625.65

[58] Field of Search ..... 91/387, 459, 467; 137/625.23, 625.65

[56] References Cited

U.S. PATENT DOCUMENTS 4,308,892 1/1982 Van Ausdal ..... 137/625.23

OTHER PUBLICATIONS

Electrodynamics Division Drawing 3335097.

*Primary Examiner*—Gerald A. Michalsky
*Attorney, Agent, or Firm*—Robert C. Smith

[57] ABSTRACT

A direct drive servo valve includes a housing and a series of conduits connecting the housing to a fluid pressure source and to an associated actuator, a sleeve in the housing having a plurality of passageways interconnecting the conduits and a spool valve member rotatable within the sleeve to connect the conduits as desired, the spool valve being rotated by a torque motor. The torque motor rotor is connected to the return side of the fluid pressure source. The sleeve is formed of a series of disks which have a desired pattern of holes therethrough and which are bonded together to create a manifold structure having the desired pattern of passageways. A rotary variable differential transformer is connected to the spool and provides feedback signals to an external circuit controlling the torque motor. A torque rod is connected to the spool and the housing to provide a preload which tends to center or "null out" the spool position when there is no input signal. A feedback lever movable with the actuator output operates through a helical nut and screw assembly to move the torque rod in such manner as to move the torque motor rotor and the spool toward null.

22 Claims, 7 Drawing Sheets

FIG. 4
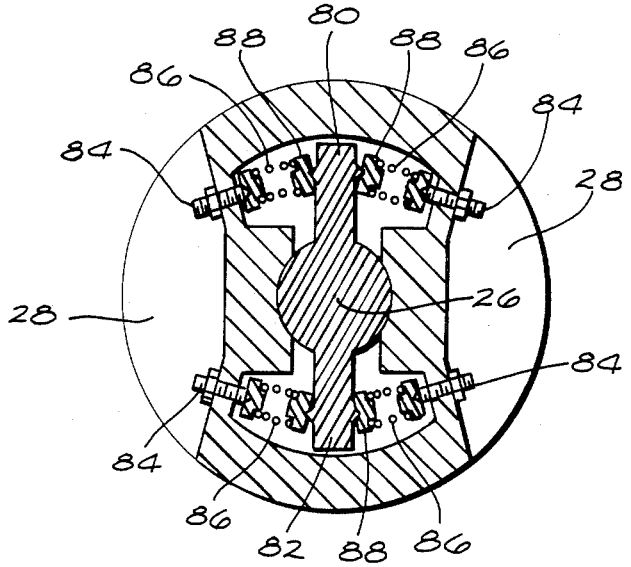
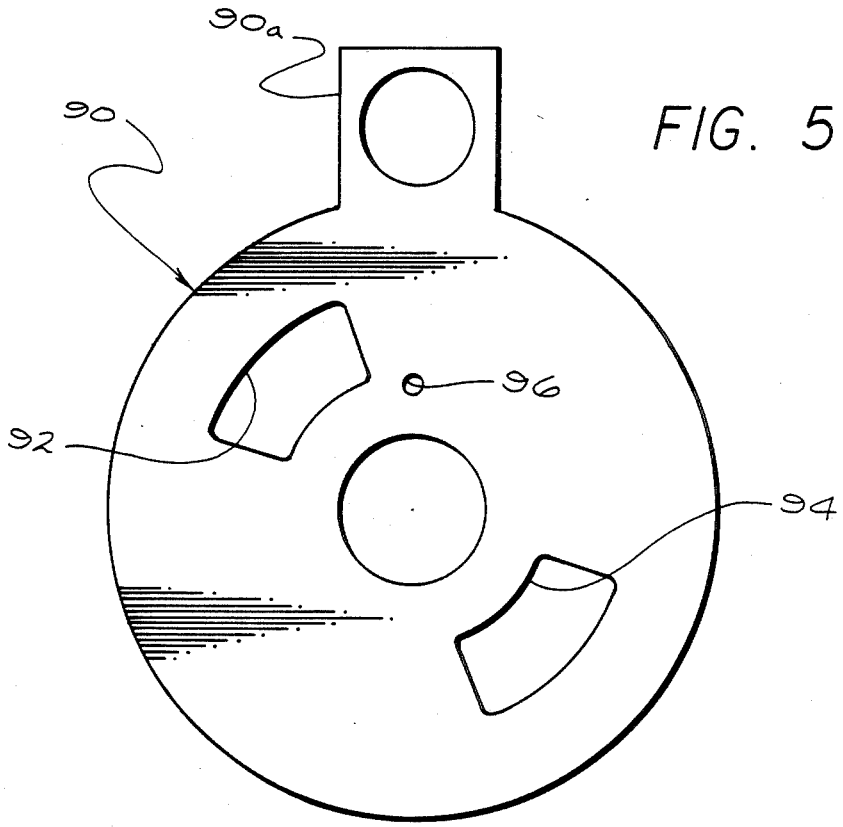
FIG. 5

FIG. 9
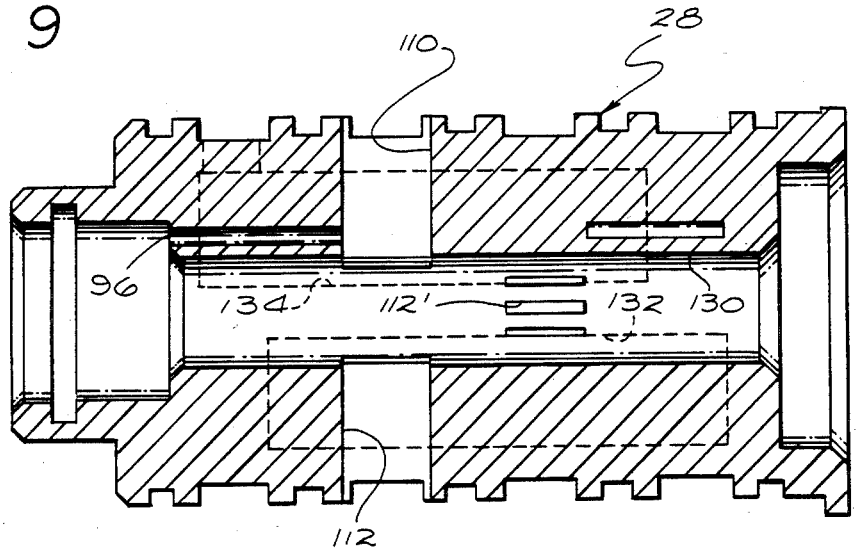
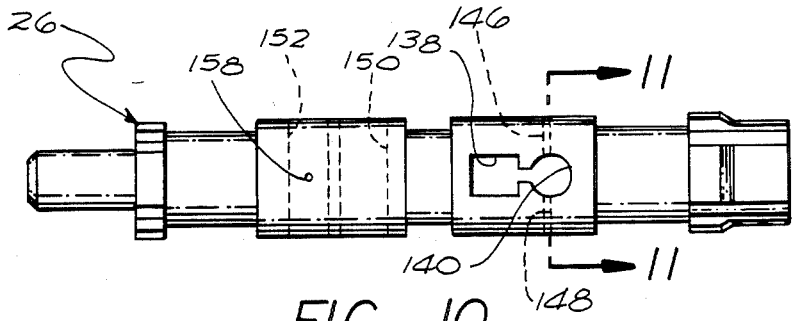
FIG. 10
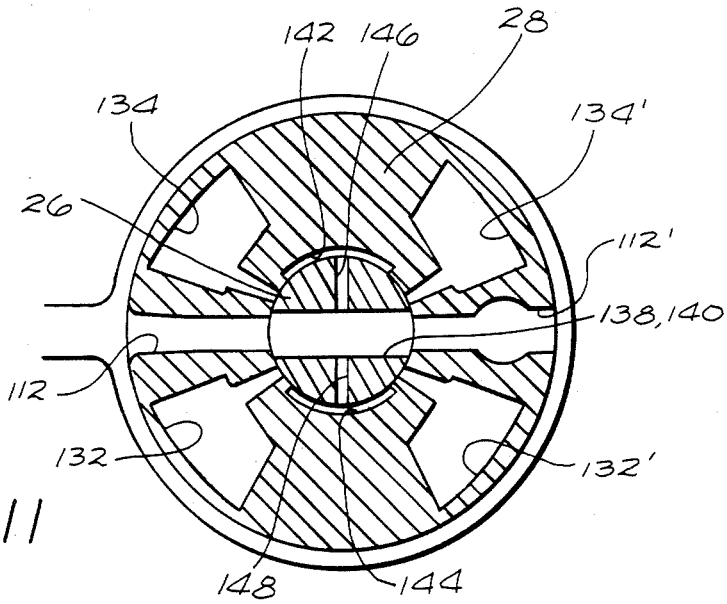
FIG. 11

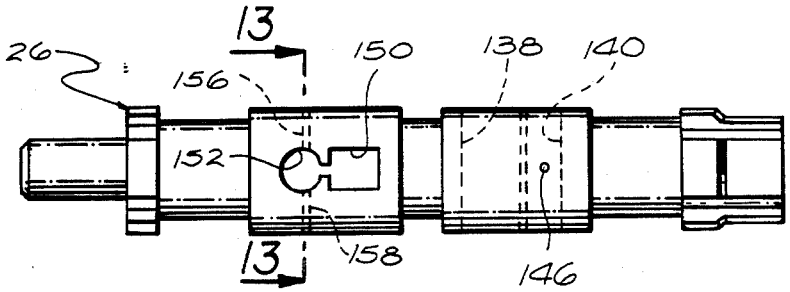
FIG. 12
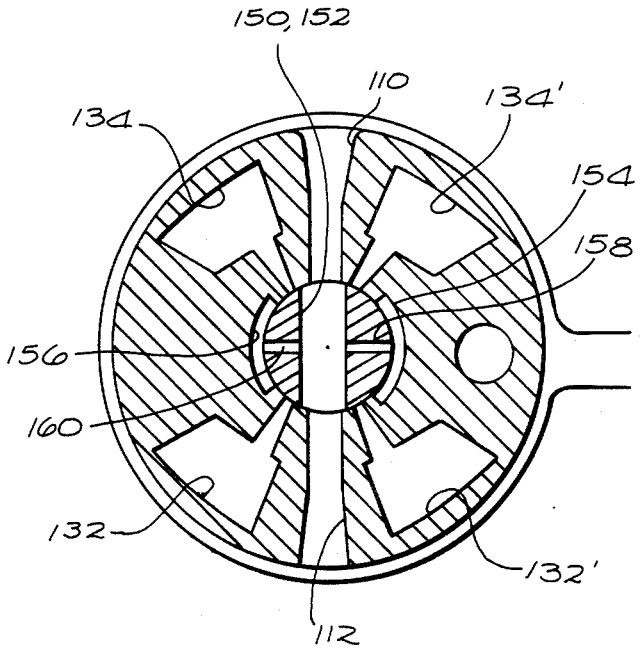
FIG. 13
FIG. 14
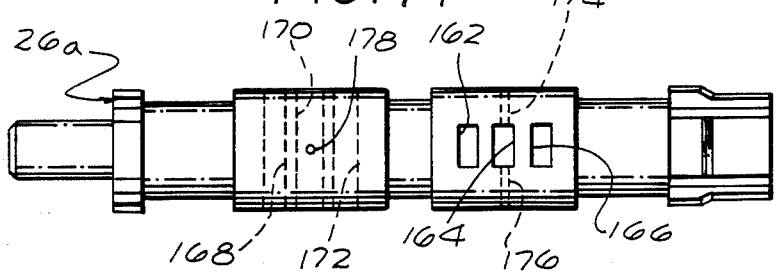

DIRECT DRIVE ROTARY SERVO VALVE

This invention relates to a direct drive rotary valve.

A direct drive rotary servo valve includes a housing containing conduits connecting fluid from a high pressure source to and from a hydraulic actuator and includes a sleeve in the housing incorporating passageways as desired to control the flow of operating fluid to the actuator, with motor means being employed to drive the spool.

The usual servo valve for controlling hydraulic actuators includes a spool valve movable linearly to direct fluid to one side or the other of an actuating piston while permitting flow from the opposite side to a return or low pressure source. The spool member may be movable manually or it may be controlled by means of a low power electrohydraulic torque motor first stage which receives electrical control signals from a control system. One disadvantage of such a system is that the electrohydraulic torque motor, which normally includes a pair of fluid jets with a flapper member movable to open one jet and partially close the other, constantly leaks certain amount of operating fluid and thus imposes a load on the pumping system. Another disadvantage is that such a torque motor drives a spool valve which is connected to both its input signal source and its output through a series of fluid conduits. This usually requires that the system incorporate at least a direct mechanical position feedback means and perhaps an electrical feedback to the torque motor as well. For a number of applications it would be advantageous if the electrical motor could drive the servo valve directly to avoid such a "floating" spool valve. And since the torque motor inherently has a rotary output but the desired servo valve output is linear, the rotary motion of the torque motor armature must be converted to a linear motion, accomplished by the jet and flapper structure discussed above which varies the fluid pressure on opposite ends of the spool valve to cause it to move linearly.

The direct drive rotary servo valve of the kind to which the invention relates utilizes a rotary torque motor having a limited displacement which operates through an output shaft to directly drive the spool of a rotary servo valve. The rotatable valve structure consists of a housing containing a sleeve made up of a number of annular disks having various patterns of flow-passages therethrough, which disks are carefully arranged, radially aligned and bonded together with end-pieces, and the assembly then machined to the desired diameter to expose the desired passageways which are aligned with conduits in the housing. The spool member is machined to the desired diameter to fit in the center of the sleeve and includes a series of channels which are rotated by the torque motor to provide the desired interconnections among the sleeve passageways.

Although rotary direct drive valves avoid some of the disadvantages referred to above, those currently available also have disadvantages, one of the most serious of which is that they tend to be unbalanced laterally; hence, tend to bind or wear on the sides. Another disadvantage is that they are subject to excessive leakage which, over time, tends to worsen because of sudden dumping of high pressure into the spool which results in eroding of valve edges.

One advantage resulting from my invention is that the rotary direct drive valve arrangement facilitates pressure-balancing of the spool in that the spool can be made symmetrical with fluid pressure forces acting on opposite sides simultaneously to reduce the required operating forces.

Another advantage of the present invention is that comparatively simple and inexpensive centering means are utililzed to assure that the spool returns to null position with electrical power off.

A further advantage is that the excessve leakage of operating fluid referred to above is minimized without resorting to certain known and expensive machining techniques.

A still further advantage is that the direct drive valve, although having rather complicated patterns of passageways in its sleeve structure, is amenable to production through the use of stacked disks having various patterns of cutouts made with electrical discharge milling (EDM) techniques or photo-etching techniques.

Other objects and advantages will become apparent from the following specification taken in connection with the accompanying drawings in which:

FIG. 4 is a sectional view of an alternate null setting arrangement usable with the direct drive valve of FIGS. 1, 2 and 3.

Figure 1:
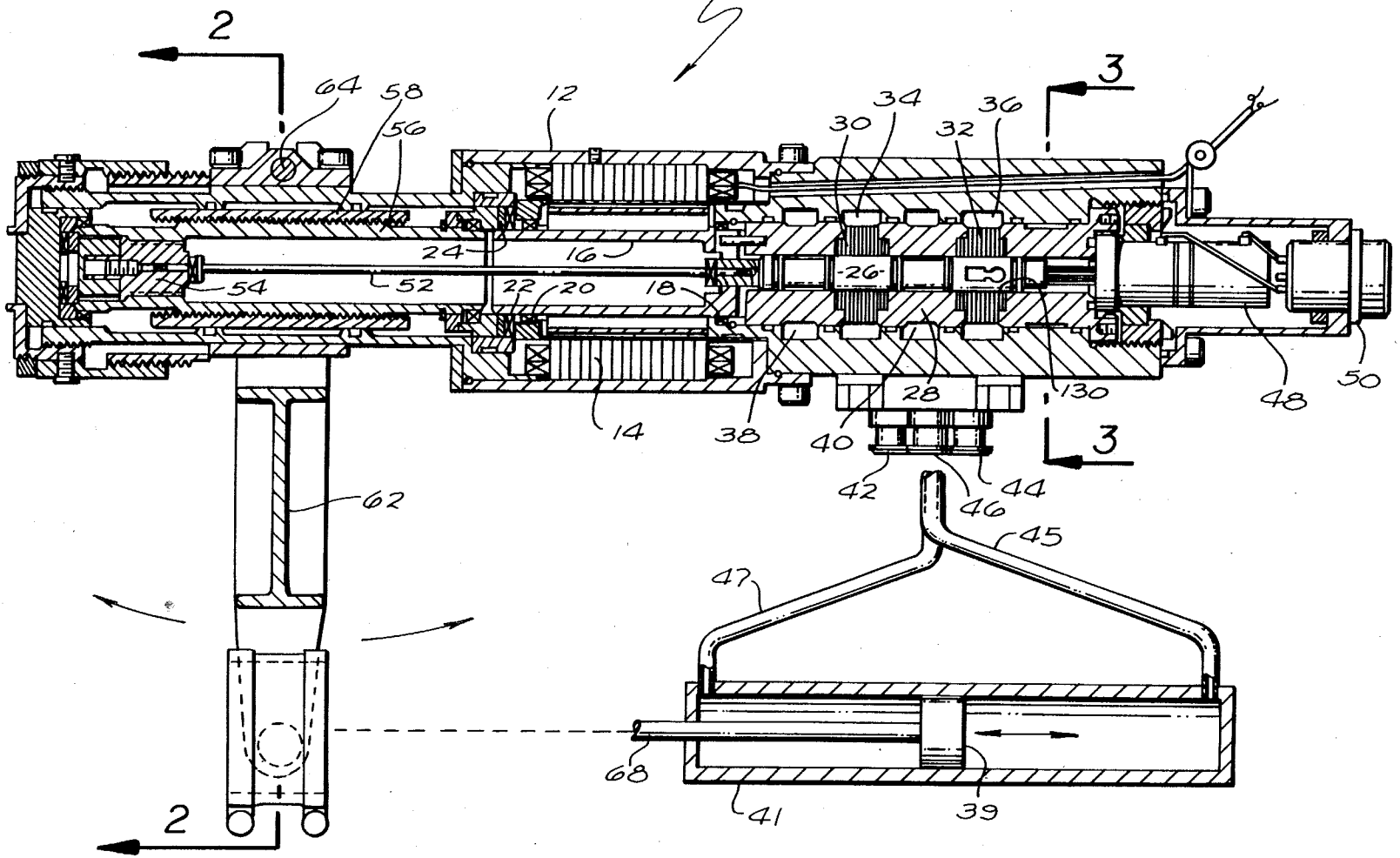
FIG. 1 is a sectional view through a direct drive valve incorporating my invention.
Figure 2:
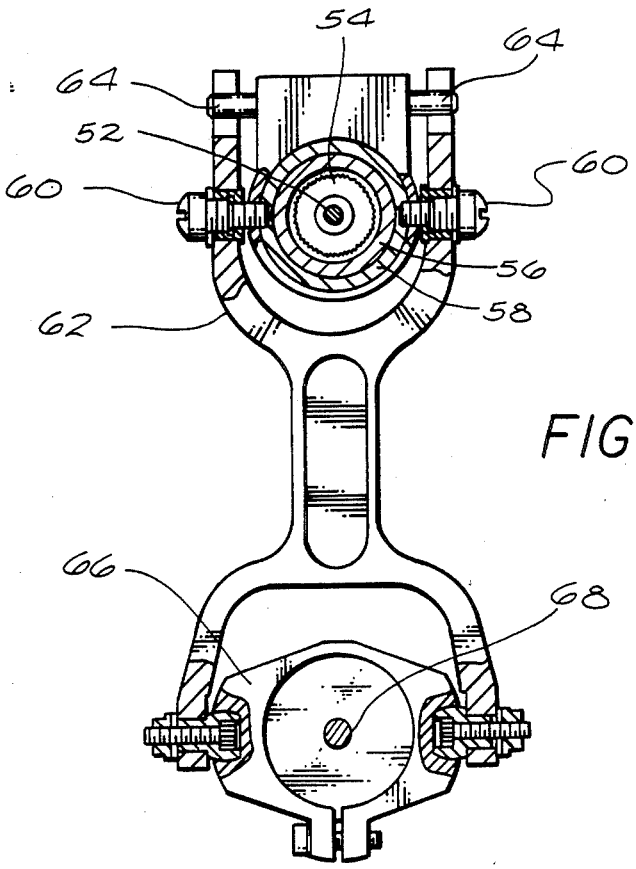
FIG. 2 is a sectional view through line 2—2 of FIG. 1.
Figure 3:
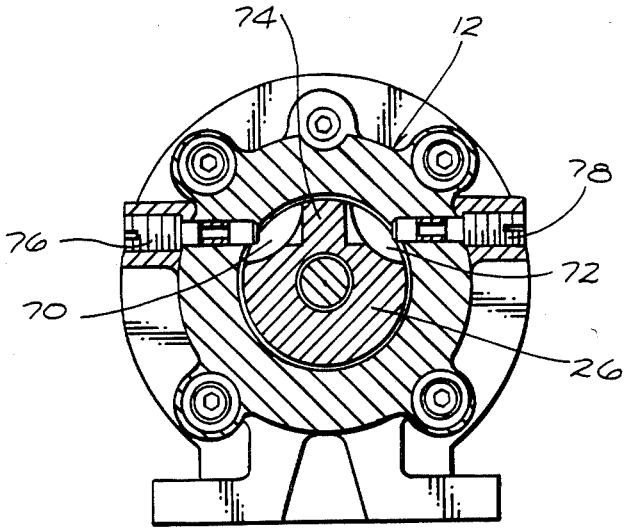
FIG. 3 is a sectional view through line 3—3 of FIG. 1.

FIGS. 5, 6A, 6, 7, and 8 are plan views of disk configurations used in the assembly of FIGS. 1, 2 and 3;

FIG. 9 is a sectional view of a sleeve adapted to be installed in the assembly of FIG. 1;

FIG. 10 is a side view of a spool adapted to be installed in the sleeve of FIG. 9;

FIG. 11 is a modified sectional view taken along line 11—11 of FIG. 10;

FIG. 12 is a top view of the spool of FIG. 10;

FIG. 13 is a modified sectional view taken along line 13—13 of FIG. 12; and FIG. 14 is a side view of an alternate form of spool adapted to be installed in the sleeve of FIG. 9

Referring to FIG. 1, a torque motor is shown at numeral 10 which includes a housing 12 containing a stator 14 including electrical windings and a rotor or driver 16 supported on bearings 18 and 20 and including a thrust bearing 22 and washer 24. Driver 16 is secured to a spool valve member 26 such that as driver 16 rotates in one direction or the other from null, the spool valve member 26 rotates with it. Surrounding spool valve member 26 is a sleeve 28 which is fixed in housing 12 and which is partially formed of a pair of sets of disk members 30 and 32. Disk set 30 communicates with an annulus 34 connected to a source of hydraulic fluid under high fluid pressure (normally 3,000 psi or more) and disk set 32 communicates with an annulus 36 connected to the return side of said source. Additional annuli 38 and 40 are connected to opposite sides of a control piston 39 in a linear actuator 41 or to opposite sides of a vane in a rotary actuator, not shown, but which is well known and understood in the art.

Annuli 34 and 36 communicate through sleeve 28 with quills 42 and 44, respectively, which are connected to high pressure and return pressure lines, respectively. Annulus 38 communicates through sleeve 28 with a quill 46 which is connected to one of two control lines 45 leading to opposite sides of actuator piston 39 of actuator 41 or vanes in a rotary actuator, as discussed above. A similar quill is unshown behind quill 46 connected to the opposite control line 47.

Spool 26 is also connected to the rotary member of a dual rotary variable differential transformer 48 (RVDT) which transformer senses the position (movement) of spool 26 and provides a position feedback signal through an electrical connector 50 to the control system (not shown) which provides the input signals to torque motor 10. The motor coils and RVDT's may be single or redundant. Also movable with spool 26 and rotor 16 is a torque rod 52 which is torsionally preloaded to rotor 16 at its right end by torsional engagement of two rectangular segments (at the shaft end) separated by a short diametral segment to absorb the torsional twist and which is fastened at its left end to a coupling member 54, similarly preloaded and splined to a helical screw member 56 threadedly engaged with a coaxial helical nut member 58. Helical nut member 58 is pinned by means of a pair of shoulder screws 60 to a lever 62 which rotates around a fulcrum 64 on housing 12 (FIG. 2). At its lower end lever 62 is pivotally attached to a collar 66 fastened to the piston rod 68 of the controlled actuator. As shown on FIG. 1, the lever swings through a substantial arc which represents the travel of rod 68 from its maximum retracted to maximum extended positions. As rod 68 moves it carries lever 62 which carries helical nut 58 over an axial distance represented by the intersections of the arc lines with the center line of the torque motor 10. As helical nut 58 moves axially, it causes screw member 56 to rotate coupling member 54 and the left end of the torque rod 52 such that rod 52 tends to move rotor 16 and spool 26 toward null. In the absence of an electrical signal on torque motor 10 this feedback arrangement will center the actuator in a null position or to any other preselected position.

FIG. 3 is a sectional view taken through line 3—3 of FIG. 1. It shows housing 12 and a part of sleeve 28 having cutouts or slots 70 and 72 to produce a vane 74. A pair of oppositely directed screws 76 and 78 are adjustable to limit the travel of vane 74 and, hence, rotation of sleeve 28 to a movement in each direction of about 15 degrees. This arrangement provides a means of adjusting the relative sleeve and spool position for null or no signal conditions.

FIG. 4 is a sectional view of a structure for presetting a hydraulic position which may be used as an alternate to, or as a supplement to, the torque rod arrangement described above. Such a structure preferably would be positioned on FIG. 1 between section line 3—3 and the RVDT 48. Fastened to or formed as part of spool 26 are oppositely directed vanes 80 and 82. Threadedly engaged with a portion of sleeve 28 or with housing 12 are four adjusting screws 84, each of which is adjustable to vary the compression of a spring 86 whose opposite end is held in a retainer 88 pivotally held on opposite sides of each end of vanes 80 and 82. This arrangement provides a very positive and effective means of establishing and maintaining the hydraulic null position.

There are a number of features of the structure of sleeve 28 which contribute significantly to the advantages referred to above. As described, disk sets 30 and 32 communicate directly with annuli 34 and 36 which carry operating fluid at high pressure and at return pressure, respectively. FIGS. 5, 6, 7 and 8 show the configuration of individual disks as initially formed. Disks 90 such as those of FIG. 5 are formed with tabs **90*a* for handling during assembly and to aid in orientation of the disks. One such disk 92 is installed with its tab 90*a* at the top of the left end of the sleeve assembly and another such disk is installed reversed adjacent the opposite end of the sleeve assembly. Each of disks 90 has openings 92 and 94 diagonally across its center bore and a small bore 96 just above its center opening. These disks could also be made with four such openings as shown in FIG. 8**.

Figure 6:
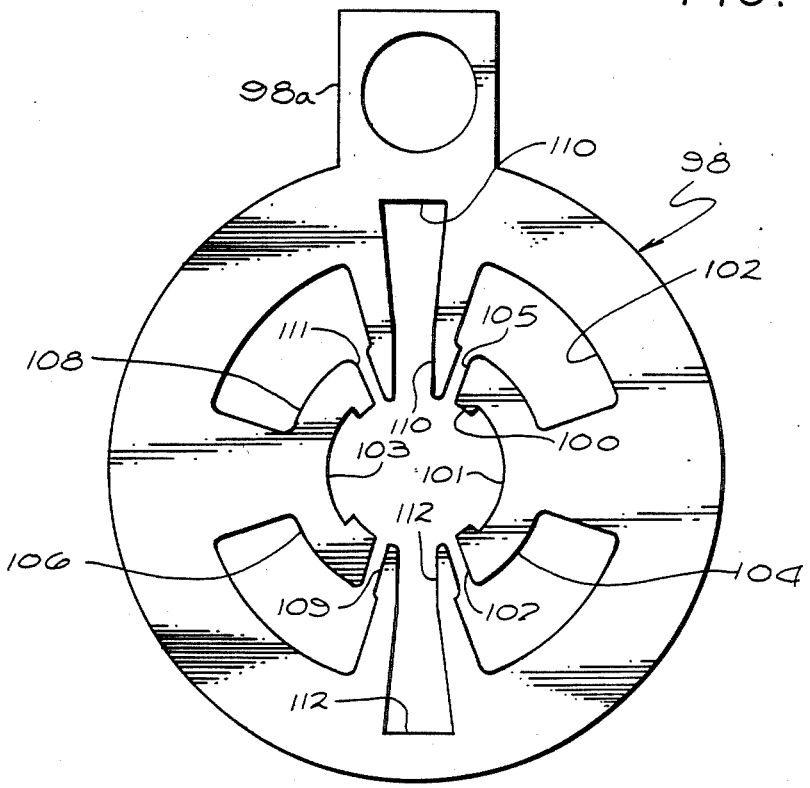
Figure 6A:
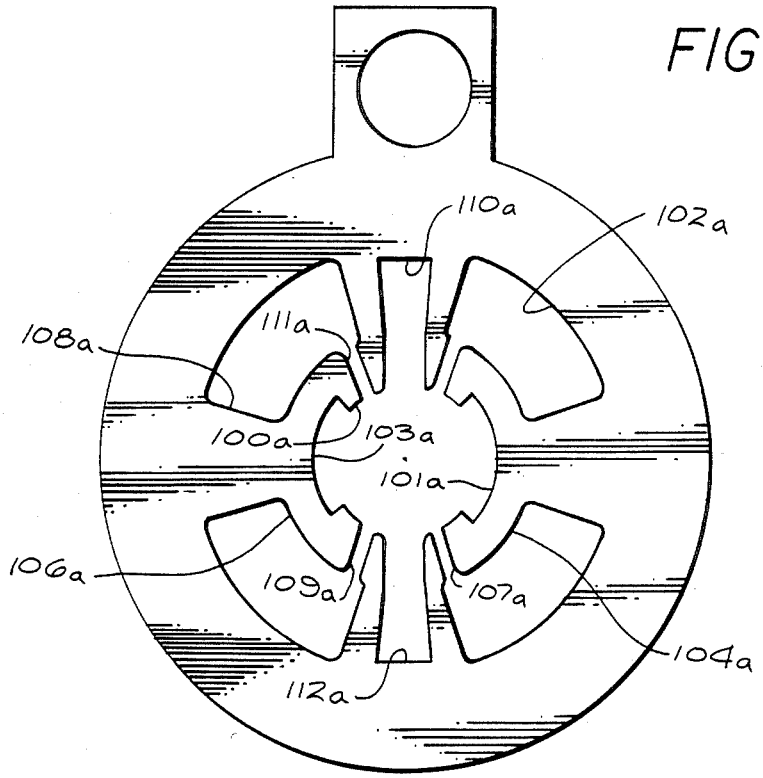
Figure 7:
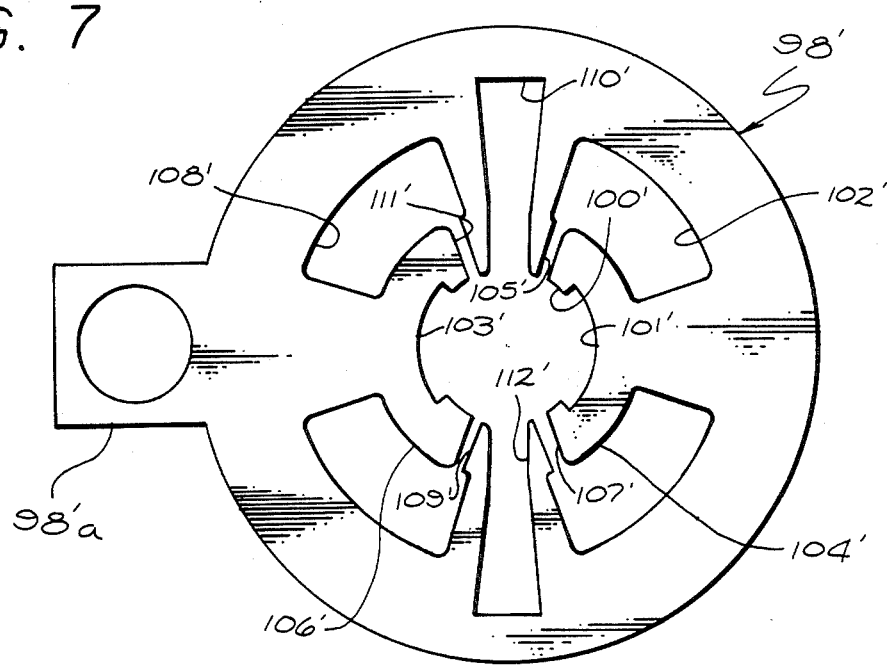
Figure 8:
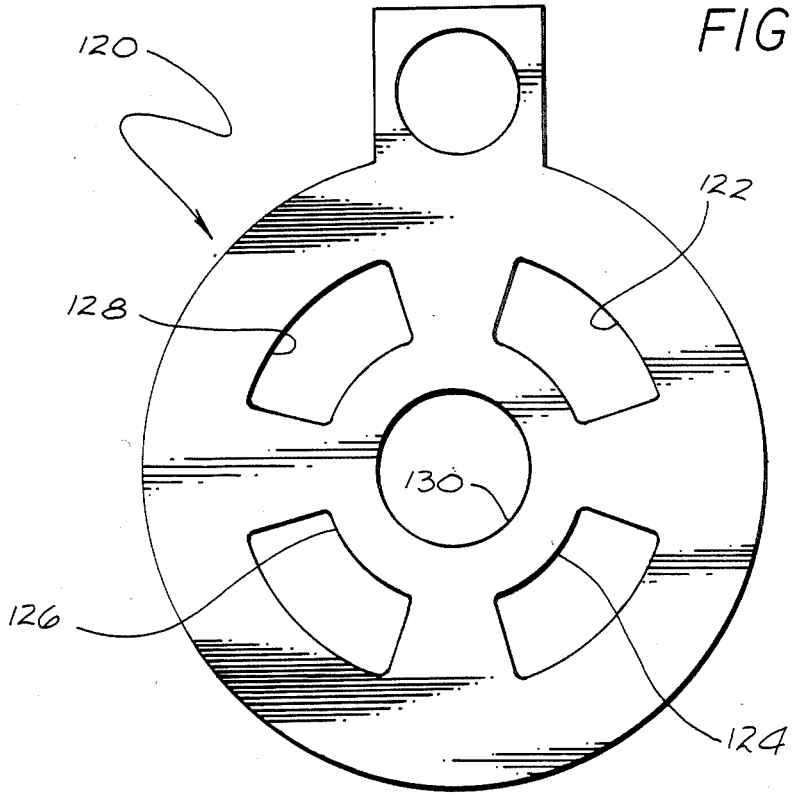

The next disks toward the center are shown in FIGS. 6A, 6 and 7. FIGS. 6 and 6A are very similar, the difference being that the vertical slots **110*a* and 112*a* of FIG. 6A do not extend radially outwardly as far as do slots 110 and 112 of FIG. 6. Disk 98' of FIG. 7 is almost identical to disk 98 of FIG. 6 except that the disk 98' includes a tab 98'*a* which is rotated 90 degrees counterclockwise as compared with the tab 98*a* of disk 98. Disks 98 and 98' include center bores 100, 100' in which spool 26 is received. These center bores of disks 98 and 98' are preferably formed with relieved portions 101,103 and 101' and 103' to provide pressure balancing as discussed below. Opening into center bore 100 are a plurality of slots 105, 107, 109 and 111 communicating with openings 102, 104, 106, and 108, all of which form parts of passageways within the completed sleeve. Also opening into center bore 100 are elongated slots 110 and 112 which extend radially a greater distance from the center than the above described openings. When the sleeve assembly is machined to the final dimensions, slots 110 and 112 become exterior openings into the sleeve, but slots 110*a* and 112*a* do not. Disks 6A are located at the outside edges of disk sets 30 and 32, providing communication internally to the spool, but communication to annuli 34 and 36** only through axial passageways.

The center disk 120 is shown in FIG. 8. This disk has openings 122, 124, 126 and 128 corresponding to openings 102, 104, 106, and 108, respectively, in FIG. 6, but with no openings into the center bore 130. All of these openings are aligned to provide elongated axial passageways. Additionally, blank disks are formed as endpieces at each end of the disk stack.

To impact sufficient stiffness to the sleeve structure after is is trimmed to the desired diameter and the openings into the sleeve are exposed, the several disks such as those shown on FIGS. 6 and 7 are alternated with a series of thin disks (0.004") of essentially the same configuration as the disks of FIG. 8 which have no openings to the spool or to the annuli 34 and 36. Since these disks are bonded to the disks which provide such openings, the spool structure is thus quite rigid despite the openings. In addition, one thin disk of configuration like that of FIGS. 6 and 7 may be incorporated in each disk set. This disk is slightly modified with slots located to provide a desired degree of underlap which gives a very limited leakage but assists in pressure control.

The above described disks are bonded together as described above and the entire sleeve assembly 28 machined to the configuration generally shown in the sectional drawing, FIG. 1, and in greater detail in FIG. 9, which shows the internal bore 130, the vertical radial passageways resulting from slots 110 and 112 (FIG. 6) and the opening to the horizontal passageway 112' appearing in disk 98' and also the adjacent slots communicating with chamber 104' and 106'. In FIG. 9 the elongated passageways 132 and 134 show in dotted outline. Passageway 132 is formed from opening 92 in disk 90 (FIG. 5,) opening 108 in disk 98 (FIG. 6), opening **108*a*** in disk 98a, opening 128 in disk 120 (FIG. 8), and opening 106' in disk 98' (FIG. 7). Similarly, the elongated passageway 134 is formed from opening 106 in disk 98, opening 106a in disk 98a, 126 in disk 120, 104' in disk 98' and 94 in the reversed disk 90 at the right end of the sleeve. This view also shows a small diameter bore 96 extending from the left end of the sleeve which communicates with slot 112. Any number of such disks may be stacked to achieve the desired length of the disk sets.

FIG. 10 is a side view showing the spool 26 which cooperates with the sleeve 28. On this view a port is shown consisting of a rectangular opening 138 adjacent a circular bore 140, which openings may be connected by means of a short slot all of which extend through the spool as shown on FIG. 11, which is a modified cross-sectional view taken along line 11—11 of FIG. 10, and on FIG. 12 which is a top view of spool 26. FIG. 11 also includes a cross section of sleeve 28 showing relieved sections 142, 144 which communicate through small orifices 146, 148 with opening 138, 140. These orifices communicate fluid pressure (in this case, return pressure) to opposite sides of spool 26 to present the spool from binding or wearing on the sides. In FIG. 12 an additional port is shown rotated 90 degrees from openings 138 and 140, which port is also formed of a rectangular opening 150 and a bore 152 connected by a small slot. FIG. 13 is a cross-sectional view similar to FIG. 11 taken along lines 13—13 of FIG. 12 and shows opening 150, 152 extending across the width of the spool 26 with relieved sections 154, 156 communicating through orifices 158, 160 with opening 150, 152. The compound port arrangement provides a means for controlling flow with great precision, particularly at the point of opening, since the bore is just slightly larger in diameter than the width of the rectangular opening; therefore, the initial valve opening is through an edge of the bore which can be lapped to very close tolerances to provide the desired initial flow pattern.

An alternate form of the spool valve member is shown in FIG. 14. In this spool 26A, the arrangement of the lands is esentially like that of spool 26, but the configuration of its ports is varied to deal with possible deformation of the spool whch can occur because of high internal pressure. In spool 26 the length of the combined ports 138, 140 and 150, 152 is such that at some value of fluid pressure, there will be a tendency for the spool to bow outwardly, thus causing it to bind on the internal surface of the sleeve. By forming the ports in a group as shown at numerals 162, 164, 166 the span across the openings is limited and the webs between the openings tend to inhibit any deformation of the spool. Openings 168, 170, 172 are comparable and interact with slots 110 and 112. Orifices 174, 176 and 178 communicate with relieved portions on the inside surface of the sleeve as a pressure balancing means are discussed above. Either form of spool may be used in combination with a sleeve structure in which the openings adjacent the spool are made smaller, more numerous and staggered so that the size of any obstacle or chip which could pass through the openings is limited. Then any single such chip or obstacle can be sheared off with the force available from the torque motor. Since the spool is of small diameter relative to the rotor of the torque motor there is a large mechanical advantage to aid in shearing such obstacles or chips.

As will be understood by those skilled in the art, upon the initial opening of a valve such as described above from the high pressure source to cylinder there will be a high flow velocity tending to create a Bernoulli force tending to close the valve. By careful controlling of the flow angle entry established by slots 105, 107, 109 and 111 (FIG. 6) these forces can be minimized and/or nearly eliminated. The cylinder to return forces can be minimized by dividing circumferential lengths of the slots into segments and by staggering the slots as set forth above.

Operation of the assembly described above is as follows. Referring to FIGS. 11 and 13, a small clockwise rotation of spool 26 connects slot 112' to opening 132' and slot 112 to opening 134. This connects annulus 40 (FIG. 1) to return pressure (R). This same rotation causes slot 110 to be connected to opening 134' and slot 112 to opening 132, which causes system pressure (P) in annulus 34 to be connected to annulus 38. This results in moving the associated actuator in a given direction which may be the retracted position.

Rotation of the spool 26 in a counterclockwise direction connects slot 112' to opening 134' and slot 112 to opening 132 which results in annulus 38 being connected to return pressure (R) annulus 36. At the same time, slot 110 (P) is connected to opening 134 and slot 112 is connected to opening 132'. This connects control pressure in annulus 40 to system pressure (P) in annulus 34, causing the actuator to be moved in the opposite direction which may be the extended position.

From the foregoing it will be appreciated that the direct drive servo valve described above provides the several advantages enumerated above as compared with the conventional electrohydraulic servo valve. It incorporates a somewhat complex manifold structure in the sleeve, but this structure is readily fabricated through the use of the stacked or assembled disks which are preferably formed either by electrical discharge milling or by photo-etching techniques.

I claim:

1. A direct drive rotary servo valve for controlling a hydraulic actuator comprising a housing including conduits connected to a source of operating fluid under high pressure and to said controlled actuator, a sleeve in said housing including a plurality of passageways therein connected to said conduits, a spool member including channels to direct operating fluid as desired among said passageways and a rotatable torque motor connected to rotate said spool member over a limited range of movement;

characterized in that said torque motor includes a housing, a rotor in said housing in communication with the return side of said high fluid pressure source, a stator in said housing and a tubular member in said housing sealing said stator from said high fluid pressure source, and a torque rod having a splined connection to at least one of said spool and a coupling member operatively connected to said housing, said operative connection including a helical screw member threadedly engaged with said coupling member and a mating helical nut member;

said spool including generally rectangular openings communicating with said channels, some of said openings including arcuate edges, said sleeves being formed of endpieces and a plurality of annular disks having axially directed passages therethrough which cooperate to define said passageways including some disks having edge openings communicating with said conduits and internal openings communicating with said openings of said spool member, said disks and endcaps being brazed together to form a unitary manifold structure and wherein said sleeve includes a first passageway connected to said high fluid pressure source, a second passageway connected to the return side of said high fluid pressure source, and third and fourth passageways connected to said controlled actuator.

2. A direct drive rotary servo valve as claimed in claim 1 wherein said spool includes oppositely directed radial ports extending from said channels to the internal surface of said sleeve and said sleeve includes relieved areas on said internal surface communicating with said ports.

3. A direct drive rotary servo valve as claimed in claim 1 wherein each of said conduits communicates with an annulus in said housing adjacent the entrance to each of said passageways, said annular disks being aranged such that the effective flow width of the entrance to said passageways is less than the metering width adjacent said spool.

4. A direct drive rotary servo valve as claimed in claim 1 including feedback means responsive to movement of said actuator connected to said helical nut member.

5. A direct drive rotary servo valve as claimed in claim 1 wherein said generally rectangular openings include cylindrical bores having said arcuate edges, said cylindrical bores being of slightly greater diameter than the width of the rectangular ports of said openings such that initial valve openings are through said bores.

6. A direct drive rotary servo valve as claimed in claim 1 wherein said generally rectangular openings include a plurality of separate rectangular openings.

7. A direct drive rotary servo valve comprising a housing including conduits connected to a source of operating fluid under high pressure and to a controlled actuator, a sleeve in said housing including a plurality of passageways therein connected to said conduits, a spool member including channels to direct operating fluid as desired among said passageways and a rotatable torque motor directly connected to rotate said spool member over a limited range of movement, said torque motor including a housing, and a rotor in said housing connected to said spool member;

characterized in that said rotor communicates with the return side of said high fluid pressure source, a tubular member in said housing seals said stator from said fluid pressure source, a torque rod is connected through a splined connection to at least one of said spool and said housing;

said spool including generally rectangular openings, said sleeve being formed of endpieces and a plurality of annular disks having axially directed passages therethrough which cooperate to define said passageways including some disks having external edge openings communicating with said conduits and internal openings adapted to communicate with said openings of said spool member and further including some disks which have only internal openings and no external openings, such that the effective flow width of the entrance to said passageways is less than the metering width adjacent said spool, a plurality of substantially thinner disks interleaved with said disks adapted to communicate with said conduits, said substantially thinner disks not having external openings, said disks and endpieces being bonded together to form a unitary manifold structure wherein said sleeve includes a first passageway connected to said high fluid pressure source, a second passageway connected with the return side of said high fluid pressure source, and third and fourth passageways connected to said controlled actuator.

8. A direct drive rotary servo valve as claimed in claim 7 wherein said disks having internal openings are arranged to form a series of staggered openings of much smaller area than the area of said spool openings.

9. A direct drive rotary servo valve as claimed in claim 7 wherein one of said thinner disks has openings to said spool slightly radially displaced from said internal openings.

10. A direct drive rotary servo valve as claimed in claim 7 wherein said spool includes oppositely directed radial ports extending from said channels to the internal surface of said sleeve and said sleeve includes relieved areas on said internal surface communicating with said ports.

11. A direct drive rotary servo valve as claimed in claim 7 wherein said torque rod connection includes a helical screw member threadedly engaged with said coupling member and a mating helical nut member.

12. A direct drive rotary servo valve as claimed in claim 11 including feedback means responsive to movement of said actuator connected to said helical nut member.

13. A direct drive rotary servo valve as claimed in claim 12 wherein a rotary variable differential transformer is connected to said spool to provide an electrical feedback signal.

14. A direct drive rotary servo valve as claimed in claim 7 wherein said generally rectangular openings include a plurality of separate rectangular ports.

15. A direct drive rotary servo valve comprising a housing including conduits connected to a source of operating fluid under high pressure and to a controlled actuator, a sleeve in said housing including a plurality of passageways therein connected to said conduits, including a first passageway connected to said high fluid pressure source, a second passageway connected to the return of said high fluid pressure source, and third and fourth passageways connected to said controlled actuator, a spool member including channels to direct operating fluid as desired among said passageways, and a rotatable torque motor directly connected to rotate said spool member over a limited range of movement, said torque motor including a housing, a rotor in said housing, and a stator in said housing;

characterized in that said rotor is in communication with the return side of said high fluid pressure source, a tubular member in said housing is provided to seal said stator from said high fluid pressure source and a torque rod is connected through a splined connection to at least one of said spool and said housing;

said spool including generally rectangular openings communicating with said channels, said sleeve being formed of endpieces and a plurality of annular disks having axially directed passages therethrough which cooperate to define said passageways including some disks having edge openings communicating with said conduits and internal openings adapted to communicate with said openings of said spool member and further including some disks having only internal openings and no external openings, said disks being arranged such that the effective flow width of the entrance to said passageways is less than the metering width adjacent said spool, said disks and endpieces being brazed together to form a unitary manifold structure.

16. A direct drive rotary servo valve as claimed in claim 15 wherein said torque rod connection includes a helical screw member threadedly engaged with said coupling member and a mating helical nut member.

17. A direct drive rotary servo valve as claimed in claim 16 including feedback means responsive to movement of said actuator connected to said helical nut member.

18. A direct drive rotary servo valve as claimed in claim 15 wherein said spool includes oppositely directed radial ports extending from said channels to the internal surface of said sleeve and said sleeve includes relieved areas on said internal surface communicating with said ports.

19. A direct drive rotary servo valve as claimed in claim 15 wherein said generally rectangular openings include a plurality of separate rectangular ports.

20. A direct drive rotary servo valve as claimed in claim 15 wherein a plurality of substantially thinner disks are interleaved with said disks adapted to communicate with said openings of said spool member, said thinner disks not having openings to said spool member or to said conduits.

21. A direct drive rotary servo valve as claimed in claim 20 wherein one of said thinner disks has openings to said spool slightly radially displaced from said internal openings.

22. A direct drive rotary servo valve as claimed in claim 18 wherein said spool includes at least one radially extending arm, and resilient means are interposed between opposite sides of said arm and adjacent parts of said sleeve for presetting a null position of said spool.

* * * * *